US010557367B2

(12) United States Patent
Blaney et al.

(10) Patent No.: US 10,557,367 B2
(45) Date of Patent: Feb. 11, 2020

(54) ACCESSIBLE RAPID RESPONSE CLEARANCE CONTROL SYSTEM

(71) Applicant: United Technologies Corporation, Farmington, CT (US)

(72) Inventors: Ken F. Blaney, Middleton, NH (US); Richard K. Hayford, Cape Neddick, ME (US); Christopher M. Jarochym, Ogunquit, ME (US)

(73) Assignee: United Technologies Corporation, Farmington, CT (US)

( * ) Notice: Subject to any disclaimer, the term of this patent is extended or adjusted under 35 U.S.C. 154(b) by 753 days.

(21) Appl. No.: 15/105,220

(22) PCT Filed: Dec. 19, 2014

(86) PCT No.: PCT/US2014/071503
§ 371 (c)(1),
(2) Date: Jun. 16, 2016

(87) PCT Pub. No.: WO2015/102949
PCT Pub. Date: Jul. 9, 2015

(65) Prior Publication Data

US 2016/0312644 A1 Oct. 27, 2016

Related U.S. Application Data

(60) Provisional application No. 61/921,821, filed on Dec. 30, 2013.

(51) Int. Cl.
*F01D 11/20* (2006.01)
*F01D 25/24* (2006.01)
(Continued)

(52) U.S. Cl.
CPC ..... *F01D 11/20* (2013.01); *F01D 5/12* (2013.01); *F01D 11/22* (2013.01); *F01D 25/24* (2013.01);
(Continued)

(58) Field of Classification Search
CPC . F01D 5/12; F01D 11/20; F01D 11/22; F01D 25/24; F01D 11/08; F01D 11/14;
(Continued)

(56) References Cited

U.S. PATENT DOCUMENTS 3,085,398 A 4/1963 Ingleson
5,096,375 A * 3/1992 Ciokailo ..... F01D 11/22 415/127
(Continued)

FOREIGN PATENT DOCUMENTS

DE 1178253 9/1964
GB 869908 6/1961
(Continued)

OTHER PUBLICATIONS

International Preliminary Report on Patentability for Application No. PCT/US2014/071503 dated Jul. 14, 2016.
(Continued)

*Primary Examiner* — Moshe Wilensky
*Assistant Examiner* — Alexander A White
(74) *Attorney, Agent, or Firm* — Carlson, Gaskey & Olds, P.C.

(57) ABSTRACT

An example active clearance control system for a gas turbine engine includes an actuator, and a case wall portion defining an aperture configured to receive the actuator. The actuator is configured to move an air seal segment, and the actuator is insertable to an installed position within the aperture through a radially outer side of the case wall portion.

14 Claims, 5 Drawing Sheets

(51) Int. Cl.
*F01D 5/12* (2006.01)
*F01D 11/22* (2006.01)

(52) U.S. Cl.
CPC ..... *F05D 2270/64* (2013.01); *F05D 2270/65* (2013.01)

(58) Field of Classification Search
CPC .. F01D 11/16; F05D 2270/64; F05D 2270/65; F05D 2240/11; F05D 2240/55; F05D 2260/50; F05D 2260/57
See application file for complete search history.

(56) References Cited

U.S. PATENT DOCUMENTS

| | | | | |
|---|---|---|---|---|
| 5,228,828 | A | 7/1993 | Damlis et al. | |
| 5,601,402 | A | 2/1997 | Wakeman et al. | |
| 5,871,333 | A | 2/1999 | Halsey | |
| 6,457,936 | B1 | 10/2002 | Leach et al. | |
| 2007/0003411 | A1 | 1/2007 | Manzoori | |
| 2010/0313404 | A1* | 12/2010 | Bates | F01D 11/22 29/402.01 |
| 2011/0044804 | A1 | 2/2011 | DiPaola et al. | |
| 2012/0057958 | A1* | 3/2012 | Klingels | F01D 11/22 415/1 |
| 2012/0275898 | A1 | 11/2012 | McCaffrey et al. | |

FOREIGN PATENT DOCUMENTS

| | | |
|---|---|---|
| GB | 2050524 | 1/1981 |
| GB | 2235730 | 3/1991 |
| JP | H07174001 | 7/1995 |
| WO | 20140200575 | 12/2014 |

OTHER PUBLICATIONS

Supplementary European Search Report for Application No. 14876467.3 dated Sep. 4, 2017.
International Search Report and Written Opinion for Application No. PCT/US2014/071503 dated Jul. 17, 2015.

* cited by examiner

ACCESSIBLE RAPID RESPONSE CLEARANCE CONTROL SYSTEM

CROSS-REFERENCE TO RELATED APPLICATION

This application claims priority to U.S. Provisional Application No. 61/921,821 filed on Dec. 30, 2013.

STATEMENT REGARDING GOVERNMENT SUPPORT

This invention was made with government support under Contract No. FA-8650-09-D-2923 awarded by the United States Air Force. The Government has certain rights in this invention.

BACKGROUND

This disclosure relates to a clearance control system for an air seal and, more particularly, to accessing the clearance control system for repair, replacement, inspection, etc.

Gas turbine engines typically include a compressor section, a combustor section, and a turbine section. During operation, air is pressurized in the compressor section. The pressurized air is mixed with fuel and burned in the combustor section to generate hot combustion gases. The hot combustion gases are communicated through the turbine section, which extracts energy from the hot combustion gases to power the compressor section and other gas turbine engine loads.

The compressor and turbine sections of a gas turbine engine typically include alternating rows of rotating blades and stationary vanes. The turbine blades rotate and extract energy from the hot combustion gases that are communicated through the gas turbine engine. The turbine vanes prepare the airflow for the next set of blades. The vanes extend from platforms that may be contoured to manipulate flow.

A case of an engine static structure can support air seals that provide an outer radial flow path boundary for the hot combustion gases. The air seals circumscribe the rows of rotating blades.

Some air seals are radially adjustable relative to the rotating blades. Radial adjustments help accommodate component deflections due to engine maneuvers and rapid thermal growth. Clearance control system can be utilized to radially adjust the air seals. The clearance control systems can include actuators. Accessing the clearance control systems for repair, inspection, etc. is difficult. Access may require that portions of the case are disassembled and removed, which can result in significant costs.

SUMMARY

An active clearance control system for a gas turbine engine according to an exemplary aspect of the present disclosure includes, among other things, an actuator and a case wall portion defining an aperture configured to receive the actuator. The actuator is configured to move an air seal segment, and the actuator is insertable to an installed position within the aperture through a radially outer side of the case wall portion.

In another example of the foregoing active clearance control system, the actuator is configured to be moved from the installed position to an uninstalled position without accessing an area radially inside the case wall portion, the actuator at least partially received within the aperture of the case wall portion when the actuator is in an installed position, the actuator withdrawn from the aperture when in the uninstalled position.

In another example of any of the foregoing active clearance control systems, the actuator includes a pedestal and a neck. The pedestal is positioned within the aperture when the actuator is in the installed position. The neck extends from the pedestal to an air seal when the actuator is in the installed position.

In another example of any of the foregoing active clearance control systems, the system includes a clip received within the aperture to limit rotation of the actuator relative to the case about a radial axis.

In another example of any of the foregoing active clearance control systems, the system includes a cap received within the aperture to limit radial outward movement of the actuator from the aperture.

In another example of any of the foregoing active clearance control systems, the cap is configured to threadably engage the case wall portion.

In another example of any of the foregoing active clearance control systems, the case wall portion comprises a portion of a turbine case.

In another example of any of the foregoing active clearance control systems, the case wall portion comprises a portion of high pressure turbine case.

In another example of any of the foregoing active clearance control systems, the actuator is moveable between a radially inner position and a radially outer position, and the actuator is configured to move to the radially outer position in response to an increase in pressure radially within the case wall portion.

An active clearance control system for a gas turbine engine according to another exemplary aspect of the present disclosure includes, among other things, a case wall, an actuator extending though the case wall, and an extension extending radially outward from the case wall. The extension provides a bore to receive a portion of the actuator.

In another example of the foregoing active clearance control system, the actuator is removeably securable within the bore.

In another example of any of the foregoing active clearance control systems, the system includes a clip to limit rotation of the actuator relative to the bore.

In another example of any of the foregoing active clearance control systems, the system includes a cap within the bore, the cap threadably engaging the extension and limiting radially outward movement of the extension.

In another example of any of the foregoing active clearance control systems, the actuator is configured to move an air seal segment radially outward in response to increased pressure in an area radially outside the case wall.

In another example of any of the foregoing active clearance control systems, the actuator includes a pedestal and a neck, the area radially between the case wall and the pedestal.

A method of installing an active clearance control system for a gas turbine engine includes, among other things, moving an actuator from an uninstalled position through a radially outer opening of a case wall portion to an installed position, the actuator extending though the case when in the installed position.

In another example of the foregoing method, the method includes pressurizing an area radially outside of a case wall portion to move the actuator and increase a tip clearance radially inside the case.

DESCRIPTION OF THE FIGURES

The various features and advantages of the disclosed examples will become apparent to those skilled in the art from the detailed description. The figures that accompany the detailed description can be briefly described as follows.

DETAILED DESCRIPTION

Figure 1:
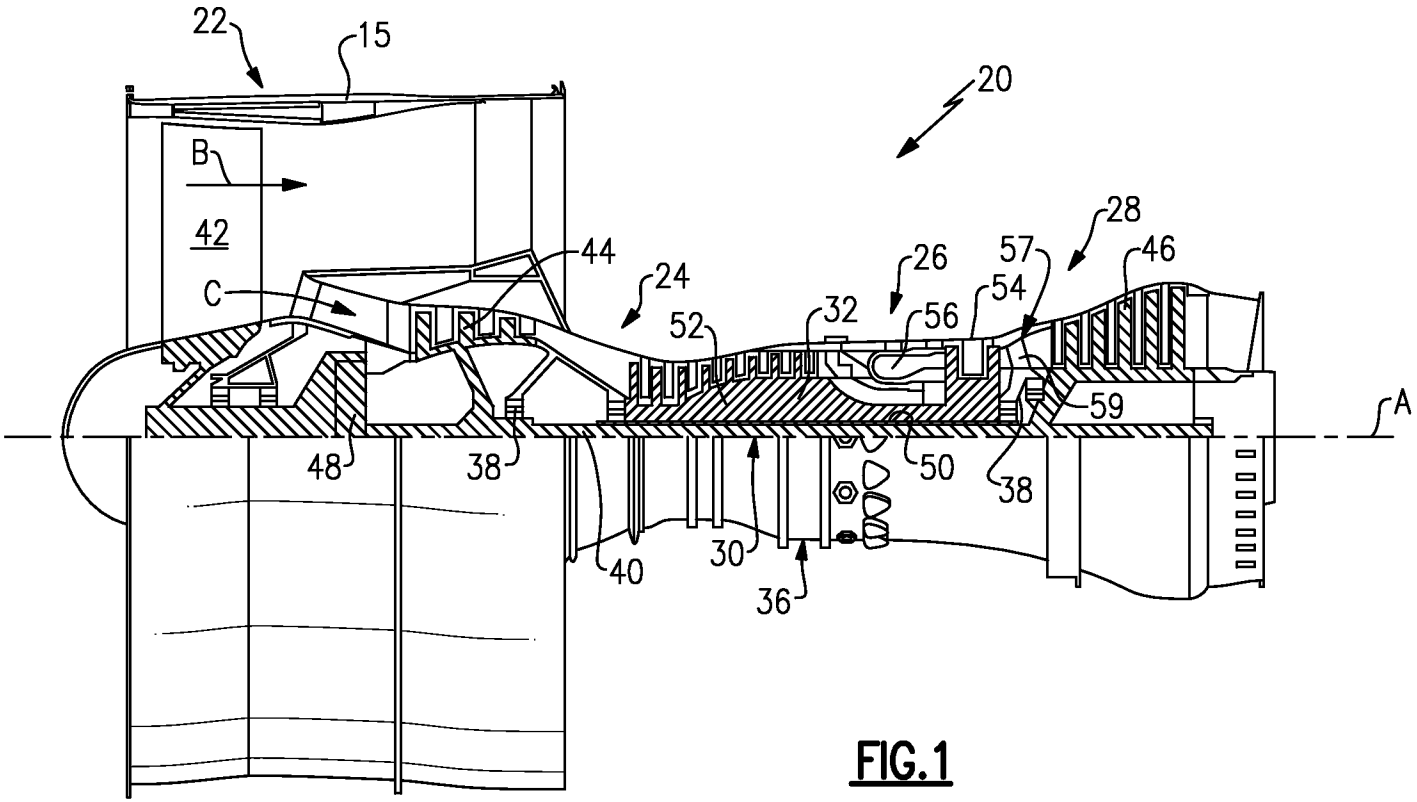
FIG. 1 illustrates a schematic, cross-sectional view of a gas turbine engine.

FIG. 1 schematically illustrates a gas turbine engine 20. The gas turbine engine 20 is disclosed herein as a two-spool turbofan that generally incorporates a fan section 22, a compressor section 24, a combustor section 26 and a turbine section 28. Alternative engines might include an augmentor section (not shown) among other systems or features. The fan section 22 drives air along a bypass flow path B in a bypass duct defined within a nacelle 15, while the compressor section 24 drives air along a core flow path C for compression and communication into the combustor section 26 then expansion through the turbine section 28. Although depicted as a two-spool turbofan gas turbine engine in the disclosed non-limiting embodiment, it should be understood that the concepts described herein are not limited to use with two-spool turbofans as the teachings may be applied to other types of turbine engines including three-spool architectures.

The exemplary engine 20 generally includes a low speed spool 30 and a high speed spool 32 mounted for rotation about an engine central longitudinal axis A relative to an engine static structure 36 via several bearing systems 38. It should be understood that various bearing systems 38 at various locations may alternatively or additionally be provided, and the location of bearing systems 38 may be varied as appropriate to the application.

The low speed spool 30 generally includes an inner shaft 40 that interconnects a fan 42, a first (or low) pressure compressor 44 and a first (or low) pressure turbine 46. The inner shaft 40 is connected to the fan 42 through a speed change mechanism, which in exemplary gas turbine engine 20 is illustrated as a geared architecture 48 to drive the fan 42 at a lower speed than the low speed spool 30. The high speed spool 32 includes an outer shaft 50 that interconnects a second (or high) pressure compressor 52 and a second (or high) pressure turbine 54. A combustor 56 is arranged in exemplary gas turbine engine 20 between the high pressure compressor 52 and the high pressure turbine 54. A mid-turbine frame 57 of the engine static structure 36 is arranged generally between the high pressure turbine 54 and the low pressure turbine 46. The mid-turbine frame 57 further supports bearing systems 38 in the turbine section 28. The inner shaft 40 and the outer shaft 50 are concentric and rotate via bearing systems 38 about the engine central longitudinal axis A which is collinear with their longitudinal axes.

The core airflow is compressed by the low pressure compressor 44 then the high pressure compressor 52, mixed and burned with fuel in the combustor 56, then expanded over the high pressure turbine 54 and low pressure turbine 46. The mid-turbine frame 57 includes airfoils 59 which are in the core airflow path C. The turbines 46, 54 rotationally drive the respective low speed spool 30 and high speed spool 32 in response to the expansion. It will be appreciated that each of the positions of the fan section 22, compressor section 24, combustor section 26, turbine section 28, and geared architecture 48 may be varied. For example, geared architecture 48 may be located aft of combustor section 26 or even aft of turbine section 28, and fan section 22 may be positioned forward or aft of the location of geared architecture 48.

The engine 20 in one example is a high-bypass geared aircraft engine. In a further example, the engine 20 bypass ratio is greater than about six (6), with an example embodiment being greater than about ten (10), the geared architecture 48 is an epicyclic gear train, such as a planetary gear system or other gear system, with a gear reduction ratio of greater than about 2.3 and the low pressure turbine 46 has a pressure ratio that is greater than about five. In one disclosed embodiment, the engine 20 bypass ratio is greater than about ten (10:1), the fan diameter is significantly larger than that of the low pressure compressor 44, and the low pressure turbine 46 has a pressure ratio that is greater than about five 5:1. Low pressure turbine 46 pressure ratio is pressure measured prior to inlet of low pressure turbine 46 as related to the pressure at the outlet of the low pressure turbine 46 prior to an exhaust nozzle. The geared architecture 48 may be an epicycle gear train, such as a planetary gear system or other gear system, with a gear reduction ratio of greater than about 2.3:1. It should be understood, however, that the above parameters are only exemplary of one embodiment of a geared architecture engine and that the present invention is applicable to other gas turbine engines including direct drive turbofans.

A significant amount of thrust is provided by the bypass flow B due to the high bypass ratio. The fan section 22 of the engine 20 is designed for a particular flight condition—typically cruise at about 0.8 Mach and about 35,000 feet. The flight condition of 0.8 Mach and 35,000 ft, with the engine at its best fuel consumption—also known as "bucket cruise Thrust Specific Fuel Consumption ("TSFC")"—is the industry standard parameter of lbm of fuel being burned divided by lbf of thrust the engine produces at that minimum point. "Low fan pressure ratio" is the pressure ratio across the fan blade alone, without a Fan Exit Guide Vane ("FEGV") system. The low fan pressure ratio as disclosed herein according to one non-limiting embodiment is less than about 1.45. "Low corrected fan tip speed" is the actual fan tip speed in ft/sec divided by an industry standard temperature correction of $[(\text{Tram}^\circ\ \text{R})/(518.7^\circ\ \text{R})]^{0.5}$. The "Low corrected fan tip speed" as disclosed herein according to one non-limiting embodiment is less than about 1150 ft/second.

Figure 2:
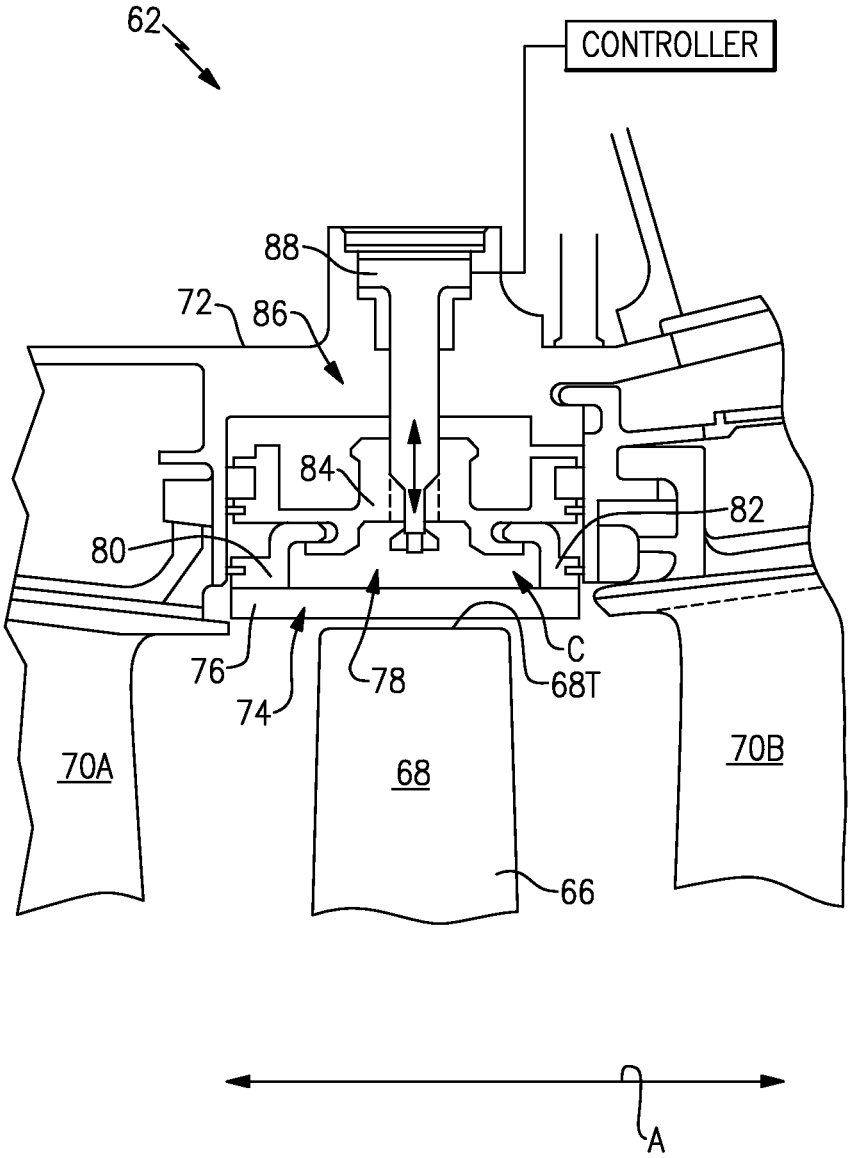
FIG. 2 illustrates a cross-sectional view of a portion of a gas turbine engine.

FIG. 2 illustrates a portion 62 of a gas turbine engine, such as the gas turbine engine 20 of FIG. 1. In this exemplary embodiment, the portion 62 represents the high pressure turbine 54. However, it should be understood that other portions of the gas turbine engine 20 could benefit from the teachings of this disclosure, including but not limited to, the compressor section 24 and the low pressure turbine 46.

In this exemplary embodiment, a rotor disk 66 (only one shown, although multiple disks could be axially disposed within the portion 62) is mounted to the outer shaft 50 and rotates as a unit with respect to the engine static structure 36. The portion 62 includes alternating rows of rotating blades 68 (mounted to the rotor disk 66) and vanes 70A and 70B of vane assemblies 70 that are also supported within an outer case 72 of the engine static structure 36.

Each blade 68 of the rotor disk 66 includes a blade tip 68T that is positioned at a radially outermost portion of the blades 68. The blade tip 68T extends toward air seal segment, such as a blade outer air seal (BOAS) assembly 74. The BOAS assembly 74 may find beneficial use in many industries including aerospace, industrial, electricity generation, naval propulsion, pumps for gas and oil transmission, aircraft propulsion, vehicle engines and stationery power plants.

The BOAS assembly 74 is disposed in an annulus radially between the outer case 72 and the blade tip 68T. The BOAS assembly 74 generally includes a multitude of BOAS segments 76 (only one shown in FIG. 2). The BOAS segments 76 may form a full ring hoop assembly that encircles associated blades 68 of a stage of the portion 62.

A cavity 78 extends axially between a forward flange 80 and the aft flange 82 of the BOAS assembly 74. The cavity 78 extends radially between the outer case 72 and the BOAS segment 76.

A secondary cooling airflow C may be communicated into the cavity 78 to provide a dedicated source of cooling airflow for cooling the BOAS segments 76. The secondary cooling airflow can be sourced from the high pressure compressor 52 or any other upstream portion of the gas turbine engine 20. During typical operation, the secondary cooling airflow provides a biasing force that biases the BOAS segment 76 radially inward toward the axis A. The BOAS segment 76 is biased toward the blade tip 68T to maximize efficiency. The forward flange 80 and the aft flange 82 engage corresponding structures on a carrier 84 to limit radially inward movement of the BOAS segment 76 as the cooling airflow C biases the BOAS segment 76 radially inward.

In this example, an active clearance control system 86 is used to overcome the biasing force to the cooling airflow C and selectively pull the BOAS segment 76 away from the blade tip 68*t*. Pulling the BOAS segment 76 away from the blade tip 68*t* may be desired during relatively rapid changes in aircraft position or operation.

The example active clearance control system 86 includes an actuator 88 that pulls against the carrier 84 to move the BOAS segment 76. The actuator 88 may respond to commands from a controller. In one example, the controller forms a portion of a Full Authority Digital Engine Control (FADEC).

In this example, the actuator 88 is accessible from a position that is radially outside the outer case 72. Accessible, in this example, means that the actuator 88 may be moved to an installed position from an uninstalled position. Thus, in this example, since the actuator 88 is accessible from the position outside the radially outer case 72, the actuator 88 may be moved from the installed position to an uninstalled position without requiring disassembly of the outer case 72. The example actuator 88 can be secured to the outer case 72 in an installed position from a position that is radially outside the outer case 72. The example actuator 88 can be removed from the outer case 72 an uninstalled from a position that is radially outside the outer case. An operator is thus not required to disassemble the outer case 72 to repair, replace or service the portions of the active clearance control system 86.

Figure 3:
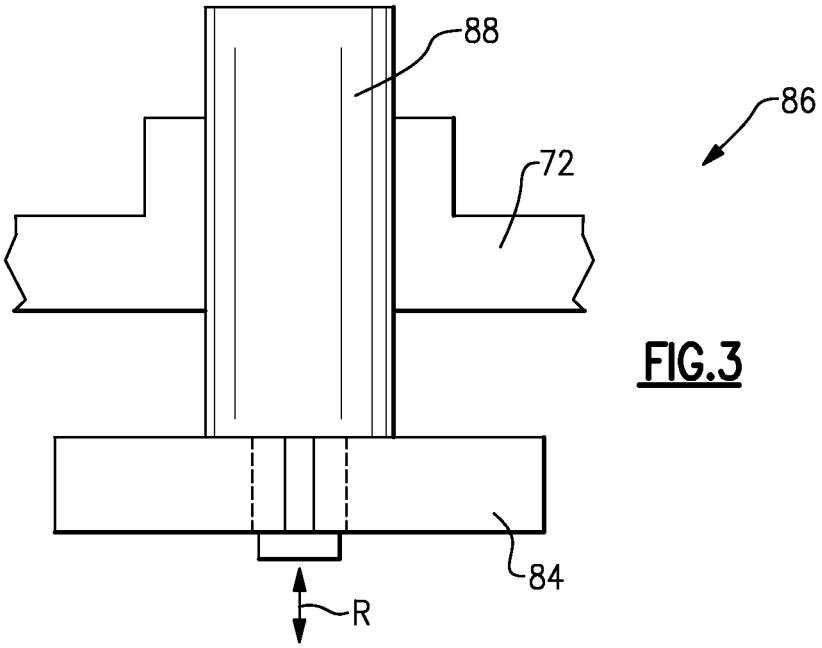
FIG. 3 illustrates a highly schematic view of an actuator of an active clearance control system of the engine of FIG. 1 in an installed position.
Figure 4:
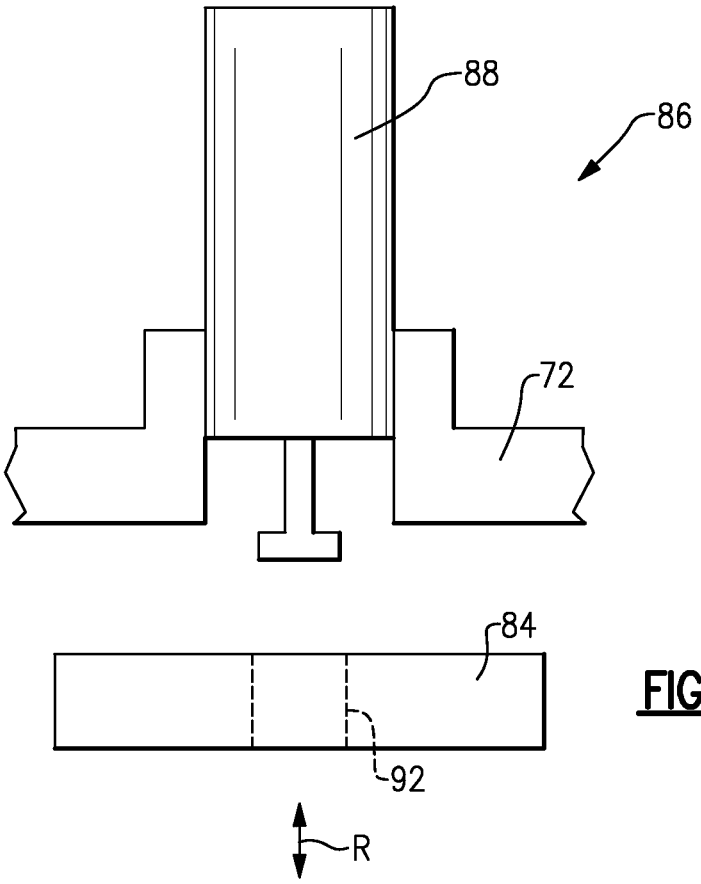
FIG. 4 illustrates the actuator of FIG. 3 in an uninstalled position.

Referring now to FIGS. 3 and 4, the actuator 88 is shown schematically in an installed position and an uninstalled position. In the installed position, the actuator 88 is configured to selectively pull against the carrier 84. In the uninstalled position, the actuator 88 is movable along a radial axis R relative to the carrier 84.

Figure 5:
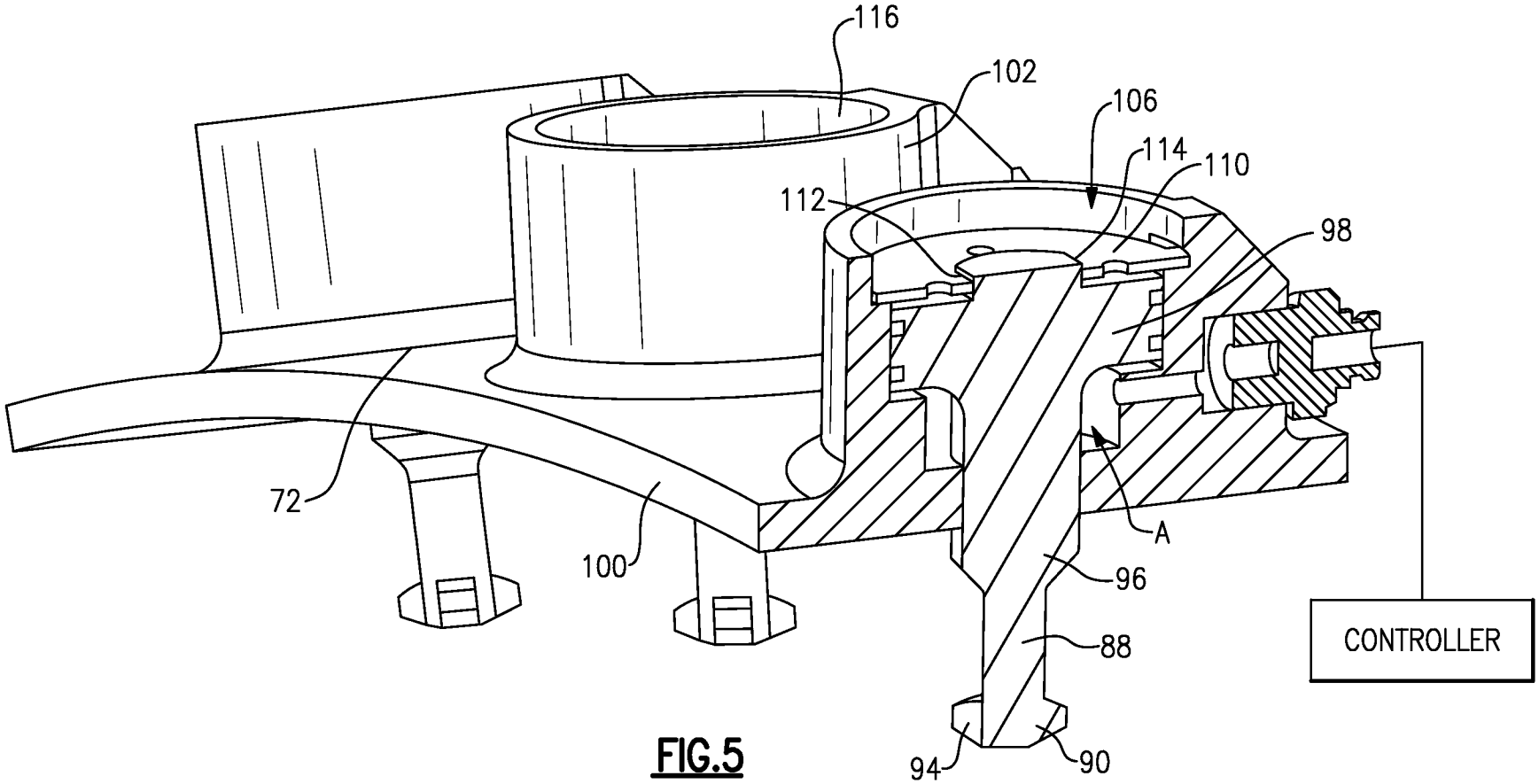
FIG. 5 illustrates a perspective, sectional view of the actuator in an installed position.
Figure 6:
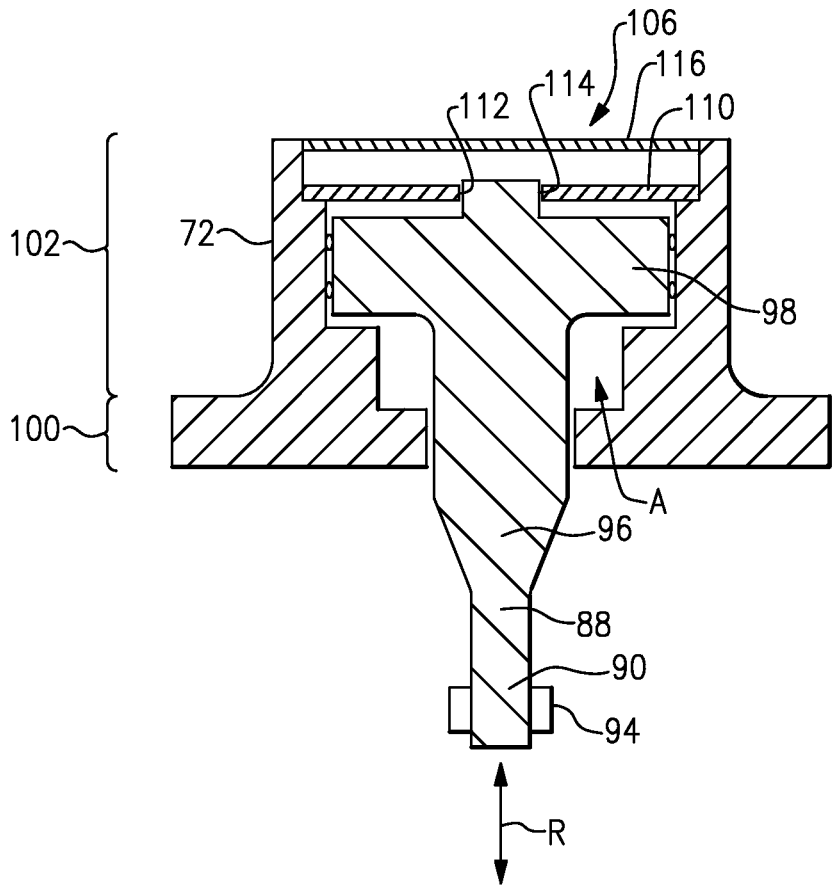
FIG. 6 illustrates a side view of the actuator of FIG. 5.

Referring now to FIGS. 5 and 6, the actuator 88 includes an enlarged head 90 that is received within an aperture 92 defined within the carrier 84. In this example, rotating the actuator 88 about a radial axis moves lugs 94 of the enlarged head 90 into a locked position that prevents the enlarged head 90 from withdrawing from the aperture 92 when the actuator 88 is moved radially outward.

The example actuator 88 further include a neck 96 extending to a pedestal 98. The pedestal 98 extends outward away from the neck 96.

The example case 72 includes a case wall 100 and cylindrical extensions 102 extending radially away from the case wall 100. The cylindrical extensions 102 provide apertures or bores 106 that receive the actuators 88. During assembly, the actuator 88 is inserted into the bore 106 until the enlarged head 90 moves through the aperture 92. The actuator 88 is then rotated about the radial axis until the lugs 94 are moved into the locked position.

After the actuator 88 is positioned within the bore 106, an anti-rotation clip 110 is installed onto the actuator 88. When installed, surfaces 112 of the anti-rotation clip contact corresponding surfaces 114 on the actuator 88 to limits rotation of the actuator 88 about the radial axis R. The anti-rotation clip 110, when installed, ensures that the lugs 94 remain in the locked position.

A cap 116 may then be secured within the bore 106. In this example, the cap 116 threadably engages an inside wall of the bore 106 to seal the bore 106 and prevent contaminants from entering the bore 106.

During operation of the engine 20 (FIG. 1), if moving the BOAS segment 76 radially away from the blade tip 68*t* is desired, pressurized air is moved into an area A provided between a portion of the actuator 88 and the case wall 100. The area A is radially within the case 72 in this example. More specifically, in this example, the area A is radially between the pedestal 98 and the case wall 100. The area A includes a portion of the bore 106 having a reduced diameter relative to other areas of the bore 106.

The pressure in the area A is selectively made greater than the pressure in the cavity 78 such that the actuator 88 is urged radially outward. Pressurizing the area A thus moves the actuator 88 from a radially inner position to a radially outer position. When the actuator 88 is moved radially outward, the enlarged head 90 pulls against the carrier 84 and moves the BOAS segment 76 radially outward to increase clearance.

The pressure in area A may then be reduced below the pressure in the cavity 78 so that the actuator 88 returns to the radially inner position. A spring can optionally be used to return the actuator.

Features of the disclosed examples include an externally mounted clearance control system. The external mounting may place the actuator 88 in an area of the engine that is relatively cooler than prior art designs. The example externally mounted system may utilized industry standard piston and guide heights to prevent binding. The externally mounted system is easier to tune than prior art systems as externally mounted valves and pneumatic lines can be replaced without disassembling the case. The air seal stops can be more easily adjusted in the eternally mounted system than in prior art designs.

The preceding description is exemplary rather than limiting in nature. Variations and modifications to the disclosed examples may become apparent to those skilled in the art that do not necessarily depart from the essence of this disclosure. Thus, the scope of legal protection given to this disclosure can only be determined by studying the following claims.

We claim:

1. An active clearance control system for a gas turbine engine, comprising:

an actuator; and a case portion defining an aperture configured to receive the actuator, wherein the actuator is configured to move an air seal segment, and the actuator is insertable to an installed position within the aperture through a radially outer side of the case portion, wherein, when in the installed position, the actuator is moveable between a radially inner position and a radially outer position, and the actuator is configured to move to the radially outer position in response to an increase in pressure in an area radially within the case portion, wherein the actuator is configured to be moved from the installed position to an uninstalled position without accessing a region that is radially inside the case portion, the actuator at least partially received within the aperture of the case portion when the actuator is in the installed position, the actuator configured to be withdrawn from the aperture when in the uninstalled position, wherein the actuator includes a pedestal and a neck, the neck positioned within the aperture when the actuator is in the installed position, the neck extending from the pedestal to an air seal when the actuator is in the installed position, wherein the case portion includes a case wall portion and an extension from the case wall portion, wherein the area radially within the case wall portion is radially between the case wall portion and the pedestal, wherein the area radially within the case portion is within the extension of the case portion.

2. The system of claim 1, including a clip received within the aperture to limit rotation of the actuator relative to the case portion about a radial axis.

3. The system of claim 2, including a cap received within the aperture to limit radial outward movement of the actuator from the aperture.

4. The system of claim 3, wherein the cap is configured to threadably engage the case portion.

5. The system of claim 1, wherein the case portion comprises a portion of a turbine case.

6. The system of claim 5, wherein the case portion comprises a portion of a high pressure turbine case.

7. The system of claim 1, further comprising a carrier engaged with the air seal segment, wherein the actuator is engaged with the carrier when the actuator is in the installed position, wherein the actuator is configured to selectively pull the carrier to pull the air seal segment when the actuator is engaged with the carrier and when the actuator is in the installed position, the actuator configured to move radially outward relative to the air seal segment when in an uninstalled position.

8. An active clearance control system for a gas turbine engine, comprising:

a case wall;

an actuator extending through the case wall;

an extension extending radially outward from the case wall, the extension providing a bore to receive a portion of the actuator, the actuator configured to move from an uninstalled position to an installed position without accessing an area radially inside the case wall, the actuator configured to move an air seal segment radially outward in response to increased pressure in an area radially outside the case wall, wherein the actuator is removeably securable within the bore; and a cap within the bore, the cap threadably engaging the extension and limiting radially outward movement of the actuator.

9. The system of claim 8, further comprising a clip to limit rotation of the actuator relative to the bore.

10. The system of claim 8, wherein the actuator includes a pedestal and a neck extending radially inward from the pedestal, the area radially between the case wall and the pedestal.

11. The system of claim 8, the actuator configured to selectively pull the air seal segment when the actuator is in the installed position, the actuator configured to move radially outward relative to the air seal segment when the actuator is in the uninstalled position.

12. A method of installing an active clearance control system for a gas turbine engine, comprising:

moving an actuator from an uninstalled position through a radially outer opening of a case to an installed position, the actuator extending through the case when in the installed position;

pressurizing an area radially outside of the case to move the actuator and increase a tip clearance radially inside the case; and limiting radially outward movement of the actuator using a cap disposed within an aperture provided by an extension of the case, the extension extending radially outward from the case.

13. The method of claim 12, wherein the actuator includes a pedestal and a neck extending radially inward from the pedestal wherein the area is radially between the case and the pedestal.

14. The method of claim 12, wherein the actuator is configured to selectively pull an air seal segment radially outward when the actuator is in an installed position, wherein the actuator is configured to move radially outward relative to the air seal segment when the actuator is in an uninstalled position.

* * * * *